United States Patent [19]

Smith

[11] 4,063,562

[45] Dec. 20, 1977

[54] PODIATRIC INSOLE

[76] Inventor: Henry M. Smith, 8575 Main St., Williamsville, N.Y. 14221

[21] Appl. No.: 732,709

[22] Filed: Oct. 15, 1976

[51] Int. Cl.[2] ..... A43B 7/14

[52] U.S. Cl. ..... 128/594

[58] Field of Search ..... 128/594, 595, 581; 36/44, 25, 29, 71

[56] References Cited

U.S. PATENT DOCUMENTS

| | | | |
|---|---|---|---|
| 2,123,730 | 7/1938 | Huttleston | 128/594 |
| 2,477,588 | 8/1949 | Dumm | 128/594 |
| 2,762,134 | 9/1956 | Town | 128/594 |
| 3,121,430 | 2/1964 | O'Reilly | 128/595 |
| 3,914,881 | 10/1975 | Striegel | 128/594 X |

*Primary Examiner*—John D. Yasko

*Attorney, Agent, or Firm*—Christel & Bean

[57] ABSTRACT

A podiatric insole of the type having upper and lower flexible walls sealed about their edges to form an envelope containing a flowable cushioning material. The envelope has one or more slits extending inwardly from the medial side thereof in the region of the shank of the shoe to facilitate curvature of the medial side portion of the insole upwardly about the arch of the wearer.

5 Claims, 4 Drawing Figures

PODIATRIC INSOLE

BACKGROUND OF THE INVENTION

This invention relates to podiatric insoles and particularly to insoles which are formed to provide a flap at the medial side of the wearer's foot adjacent to the shank portion of the shoe.

A wide variety of podiatric insoles are known in the prior art including insoles which in effect comprise envelopes containing liquid, semi-liquid or other flowable material whereby the insole conforms to the contours of the wearer's foot. Insoles known in the prior art are probably least effective in the area at the medial side of the wearer's foot between the sole and heel portions. Lack of proper fitting and conformation in this area is also likely to cause discomfort to the wearer.

SUMMARY OF THE INVENTION

While the principles of the present invention are adaptable to insoles of varying construction, those principles are particularly effective in insoles which involve upper and lower sheet members which are sealed to each other about their margins to form an insole envelope. This envelope contains flowable material which permits the insole to adjust in thickness at various parts throughout the area of the insole to conform to the countour of the bottom of the wearer's foot. Examples of insoles of this general type are found in my prior U.S. Pat. Nos. 3,469,576 dated Sept. 30, 1969 and 3,765,422 dated Oct. 16, 1973.

The insole of the present invention is so formed that a portion thereof at the medial side between the sole and heel portions is free to wrap upwardly at the shank portion of the shoe. This permits the insole to conform more closely to the wearer's foot and the interior of the shoe in this area and avoids distortion of the insole and consequent discomfort to the wearer.

DESCRIPTION OF THE ILLUSTRATED EMBODIMENTS

Figure 1:
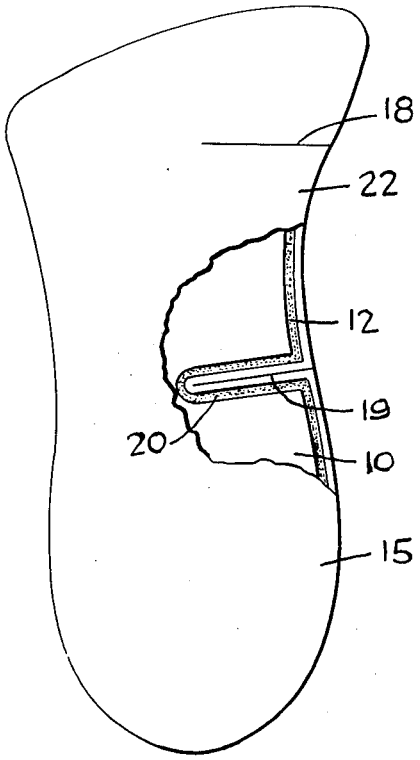
FIG. 1 is a general top plan view of one form of the insole of the present invention with portions broken away for added illustration.
Figure 2:
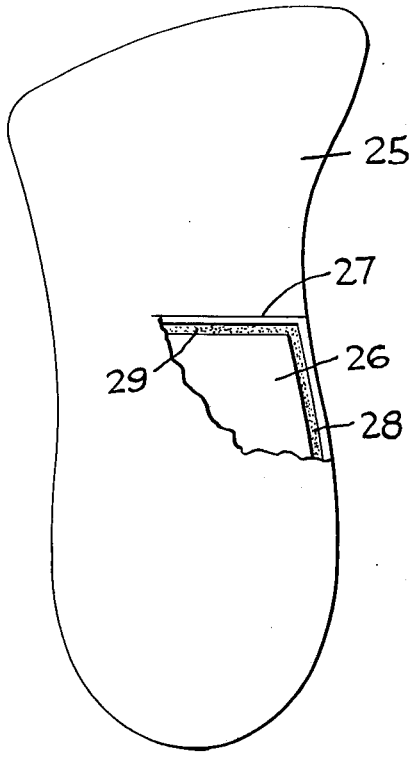
FIG. 2 is a similar view of a modified form of the insole of the present invention.

FIGS. 1 and 2 show generally insoles of the type which include the heel and shank portions of the interior of the shoe and parts of the sole portions extending up to a line lying just behind the metatarsal portion of the foot. The principles of the present invention are equally applicable to full-length insoles. For purposes of illustration insoles for left shoes are shown in FIGS. 1 and 2.

Figure 3:
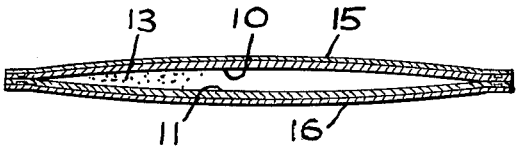
FIG. 3 is a transverse cross-sectional view of either of the embodiments of FIGS. 1 and 2.
Figure 4:
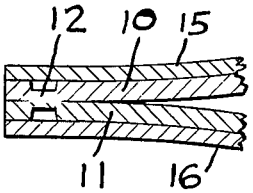
FIG. 4 is a fragmentary enlargement of the left hand portion of FIG. 3.

Referring particularly to FIGS. 1 and 3, the insole shown herein by way of example comprises basically upper and lower sheets of flexible fluid-tight material 10 and 11, respectively, which are heat sealed along their marginal portions as indicated at 12 in FIGS. 1 and 4. The envelope thus formed contains a flowable material as indicated at 13 and this material may vary widely in nature. One such material is liquid or semi-liquid silicone.

While the sheets 10 and 11 may be of various materials which are flexible, fluid-impervious, and heat-sealable, an example of a highly satisfactory material for this purpose comprises nylon fabric impregnated with polyurethane.

In the illustrated instances herein disclosed, the envelope comprising the sheets 10 and 11 has an upper protective layer 15 of Naugahyde or similar finishing material and a lower layer of a fibrous material 16 which is provided to have sufficient frictional engagement with the sole of a shoe in which the insole is inserted to prevent slipping or sliding of the insole therein. The layers 15 and 16 are preferably adhesively secured to the upper surface of sheet 10 and the lower surface of sheet 11, respectively. If the envelope sheets 10 and 11 are of sufficient thickness and strength, the outer protective layers 15 and 16 may be omitted.

In the insole embodiment illustrated particularly in FIG. 1 a pair of slits 18 and 19 extend inwardly at the medial side of the insole and are spaced in a longitudinal direction. The heat seal of the sheets 10 and 11 which is designated 12 in FIG. 1 extends inwardly of the insole about each of the slits 19 as indicated at 20 in FIG. 1.

It will be noted that the slits 18 and 19 are, generally speaking, at the forward and rear ends of the shank portion of the insole and they provide what is, in effect, a flap member 22 which is free to curve upwardly with respect to the remainder of the insole and thus follow the natural curve of the medial side of the arch of the wearer. The slits 18 and 19 may be variously angularly directed as various considerations may dictate.

In the embodiment of FIG. 2, the upper Naugahyde layer is designated 25 and the upper envelope sheet is designated 26. The remainder of the layers forming the device will be illustrated in FIG. 3. In FIG. 2 the insole is provided with a single slit 27 and, as in the previous embodiment, a heat seal 28 which hermetically joins the margins of the envelope sheet 26 and the lower envelope sheet (not shown) extends inwardly about slit 27 as shown fragmentarily at 29 in FIG. 2.

In the embodiment of FIG. 2 the single slit forms what may be characterized as adjacent triangular flaps which are free to curve upwardly against the medial side of the arch of the wearer.

In addition to the slit arrangements shown in FIGS. 1 and 2, a series of three slits may be employed. In this modification, the center slit would probably be deeper than the two end slits whereby the two flaps thus formed can conveniently be curved upwardly in a manner somewhat similar to that described above in connection with the embodiment of FIG. 2.

As a further extension of the teachings of the present invention, the slits described in conjunction with the foregoing embodiments may be omitted and the marginal portion of the insole at the medial side thereof and in the area of the shank of the shoe may be extended to form a projecting flap for curving upwardly about the medial side of the arch of the wearer.

The insoles illustrated herein by way of example show insole envelopes which contain only the slits which permit the desired conformation of the insole to the medial arch portion of the wearer's foot. However, it is to be understood that insoles constructed in accordance with the present invention may, in addition, be provided with heat sealed lines or other means to form various dividing walls or partitions in the envelope to restrict or guide the flow of the flowable material in the envelope, as generally exemplified in my two prior insole patents identified above.

Preferred embodiments of this invention having been hereinabove described and illustrated in the drawings, it is to be understood that numerous modifications thereof can be made without departing from the broad spirit and scope of this invention as defined in the appended claims.

I claim:

1. A podiatric insole conforming generally in outline to at least a portion of the wearer's foot including the central arch portion thereof, said insole comprising an upper wall adapted to engage against the under side of the wearer's foot and a lower wall connected along its margin to said upper wall to form a closed envelope, said envelope containing a flowable cushioning material, said envelope having slit means at said medial side extending inwardly thereof to provide a portion which is adapted to curve upwardly against the medial side of the arch of the wearer, the upper and lower walls of said envelope being connected along the opposite edges of said slit means to form a closed envelope.

2. A podiatric insole according to claim 1 wherein said slit means comprises a single slit.

3. A podiatric insole according to claim 1 wherein said slit means comprises a pair of slits spaced longitudinally along the insole at the medial side thereof and extending inwardly to define a flap portion at the arch of the wearer adapted to curve upwardly to conform to the medial side of the wearer's arch.

4. A podiatric insole according to claim 1 wherein said slit means comprises a plurality of slits spaced longitudinally along the insole at the medial side thereof extending inwardly in the general region of the shank portion of the associated shoe.

5. A podiatric insole according to claim 1 wherein said upper and lower walls comprise heat sealable material and wherein said walls are heat sealed about their margins with said heat sealing extending about said slit means.

* * * * *